United States Patent [19]

Merz

[11] 4,443,343

[45] Apr. 17, 1984

[54] METHOD AND APPARATUS FOR MANUFACTURING PLANAR FIBER WEBS FROM SHORT, ORIENTED REINFORCEMENT FIBERS OR FIBER BLENDS

[75] Inventor: Herbert Merz, Munich, Fed. Rep. of Germany

[73] Assignee: Motoren- und Turbinen-Union Munich GmbH, Munich, Fed. Rep. of Germany

[21] Appl. No.: 402,905

[22] Filed: Jul. 29, 1982

[30] Foreign Application Priority Data

Aug. 11, 1981 [DE] Fed. Rep. of Germany ..... 3131643

[51] Int. Cl.[3] ..... B01D 33/02

[52] U.S. Cl. ..... 210/768; 210/781; 210/380.1; 162/213; 162/292

[58] Field of Search ..... 210/768, 770, 772, 781, 210/360.2, 378, 380.1; 162/213, 292

[56] References Cited

U.S. PATENT DOCUMENTS

| | | | |
|---|---|---|---|
| 2,312,545 | 3/1943 | Haug | 210/380.1 |
| 2,859,668 | 11/1958 | Bealyn | 162/292 |
| 3,115,098 | 12/1963 | Berlyn | 162/213 X |
| 3,438,501 | 4/1969 | Oyen | 210/380.1 |
| 3,797,662 | 3/1974 | Titus | 210/772 |
| 4,016,031 | 4/1977 | Bagg et al. | 162/213 |
| 4,158,596 | 6/1979 | Justus | 162/292 |

FOREIGN PATENT DOCUMENTS

| | | | |
|---|---|---|---|
| 2751433 | 12/1978 | Fed. Rep. of Germany | 210/360.2 |
| 821619 | 5/1979 | U.S.S.R. | 210/360.2 |

*Primary Examiner*—John Adee

*Attorney, Agent, or Firm*—Scully, Scott, Murphy & Presser

[57] ABSTRACT

Method and apparatus for manufacturing planar fiber webs from reinforcing fibers which are oriented in their passage through a hydrodynamic orientation section and deposited on a filter surface. In the process, the rotating orientation section produces a laminar flow pattern causing the reinforcing fibers in the slurry to be oriented. The filter surface is rotated, as is the orientation section, to hasten the extraction of the slurry liquid by filtration, to improve the degree of orientation of the fibers, and to fix the oriented fiber cake on the filter area. Extraction of the slurry liquid by filtration eliminates the need for washing or rewashing.

15 Claims, 4 Drawing Figures

METHOD AND APPARATUS FOR MANUFACTURING PLANAR FIBER WEBS FROM SHORT, ORIENTED REINFORCEMENT FIBERS OR FIBER BLENDS

BACKGROUND OF THE INVENTION

1. Field of the Invention

The present invention relates to a method and apparatus for manufacturing planar fiber webs from short, oriented reinforcing fibers or fiber blends, wherein the reinforcing fibers or fiber blends are elutriated in a slurry liquid and subsequent to passing through a hydrodynamic orientation section, the fibers are deposited in an oriented condition on a filter surface while the slurry liquid is filtered off.

2. Discussion of the Prior Art

Methods are currently known for manufacturing planar performs or semifinishes, also referred to as fleece of fiber mats, of discontinuous (short), non-oriented reinforcing fibers. Their particular advantage, besides being inexpensive and ease of processing, lies in their uniform strength at all cutting angles. This strength, however, is in general rather low.

For the manufacture of high-strength components, the reinforcing fibers must be oriented in the form of continuous, endless individual filament strands (rovings), or layers (woven fabrics, roving bands, unidirectional roving prepregs, woven fabric prepregs), or in the form of unidirectionally oriented short fibers (UD short fibers) in the form of mats or mat prepregs. A prepreg is a semifinished article which is preimpregnated with a reactive resin blend and then predried.

The use of such UD short-fiber mats represents a compromise between high strength and good processability (ability to hug the contours of complex-surface molds, and so forth), between maximum utilization of the material and cost economy, and it facilitates the homogeneous, selective admixture of various types of fibers (socalled hybrid fiber materials).

Until the present, principally two methods for manufacturing UD short fiber mats have become known: the ERDE process (Explosives Research and Development Establishment, Waltham Abbey, UK; Lit.: Dingle, L.E., Conf. Carbon Fibres, London, February 1974, the Plastics INstitute ISBN 090310704X Paper No. 11); and the socalled MBB vacuum barrel filter process (German Patent Specification 2 163 799; Richter, H., Kunststoffe 67 (1977) 12, p. 739). Both methods have the common feature in that the short reinforcement fibers or fiber blends are converted into a slurry by employing a suitable liquid, preferably glycerine, and after passing through a hydrodynamically operating orientation section, they are deposited in an oriented condition. In the ERDE process this is achieved through orienting within a single moving nozzle and deposition on plane filter panels, whereas in the MBB vacuum barrel filter process this is achieved by means of a wide pouring trough which is formed by a separate component and has guide ducts running in parallel with the direction of the slope and with the deposition of the fibers on the exterior of a horizontally rotating filter barrel, with the slurry liquid being aspirated into the interior of the barrel under the effect of a vacuum.

In both of the prior art methods the filter cake, after deposition, must be carefully washed several times in order to remove the glycerine, which is incompatible with the subsequent resin impregnating process. Hereby the orientation of the fibers may again be disturbed. The two methods also have in common that they operate very slowly because, initially, the slurry liquid must flow laminarly in the nozzles or ducts so as to effect the orientation of the fibers and, secondly, both methods operate only a single deposition nozzle or trough. Moreover, both methods operate principally discontinuously.

SUMMARY OF THE INVENTION

Accordingly, it is a primary object of the present invention to provide a method and apparatus for manufacturing planar fiber webs from short, oriented reinforcing fibers of fiber blends of said type, in which the deposition process is accelerated with the degree of orientation remaining unchanged while eliminating the need for subsequent washing so as to improve the overall degree of efficiency.

It is a more specific object of the present invention to provide a method in which the slurry of reinforcing fibers or fiber blends is introduced at a central location to the inlet of a hydrodynamic orientation section rotating about a vertical axis at an essentially laminar flow. In particular, the rotational speed of the outlet of the orientation section is selected to be different, preferably somewhat higher than the rotational speed of the rotating filter surface which at least partially encompass in concentricity the orientation section. Firstly, the present invention utilizes the centrifugal force acting on the orientation section in order to produce an accelerated laminar flow of the slurry liquid together with the fibers so that the originally uniformly distributed reinforcing fibers or fiber blends will orient themselves. Secondly, in accordance with the rotational speed, the oriented fibers which exit from the orientation section are slung with a comparably high speed relating onto the adjacent rotating filter surface without impairing the degree of orientation. Inasmuch as the filter surface rotates at a speed differing from that of the orientation section, conversely, the orientation extent is further improved. The rotating filter surface additionally serves as an internal filter centrifuge in which the slurry liquid is centrifuged off under the effects of centrifugal force. Due to the centrifugal force acting on the filter surface the fibers remain fixed in their oriented position during the entire filtration process. Accordingly, the present invention not only accelerates the deposition of the fibers, but also, particularly as a result of the centrifugal action of the filter surface, obviates the need for rinsing or rewashing as is required in the known methods. The methods of the present invention can be applied either continuously or discontinuously.

Another advantageous feature of the inventive method provides for the reinforcing fibers or fiber blends in the slurry being conducted centrally to serveral orientation sections arranged in a star-shaped format relative to each other.

In a further advantageous embodiment of the present invention the viscosity of the slurry liquid is selected to be low, enabling the inner wall of the orientation section to be formed with a relatively rough surface without causing the laminar parabolic distribution of the flow velocity needed for orientation to be subjected to turbulent flow. This facilitates the employment of solvents as slurry liquid which can either be easily evaporated through subsequent drying, or correlated so as to be adapted with the impregnating resin, which normally also contains a solvent, in the subsequent impregnating process. This eliminates the need for the repeated, time-consuming rewashing operations which are performed on the known UD mats. Instead, the slurry solvent can have added thereto a small amount of the resin or resin-hardener mixture as a temporary binder.

The separation speed is considerably increased by the plurality of star format-arranged orientation sections and by the relatively high throughput for each orientation section, due the pumping pressure and the low viscosity of the slurry liquid.

A further feature of the inventive process resides in that the filtration process is supported through the application of a partial vacuum on the radially outer region of the filter surface.

Pursuant to another aspect of the present invention, a separating substrate foil is deposited on the oriented, deposited fibers subsequent to an impregnating and drying operation, and the filter surface drawn off. The substrate foil is suitably applied through rolling. This method is especially suitable when continuously employed; in essence, with an essentially endless filter surface which is then only partially conducted about the rotating orientation section (FIG. 3).

For other requirements, at a suitable selection of the material for the filter surface, the filter material itself can also advantageously constitute the substrate and consist of an integral component of the UD short-fiber mat. The finished product will then be a hybrid laminate onto which the separating foil is rolled after the impregnating and drying.

The inventive method can be also particularly employed in the manufacture of glass, ceramic or metal foils with short-fiber reinforcement, for example, when the filter surface is replaced by an externally cooled steel web.

An arrangement which is operated in accordance with the method of the present invention distinguishes itself through a centrifugal pump impeller rotating about an essentially vertical axis, and having substantially radially extending laminar-flow nozzles, the pump inlet for the slurried reinforcing fibers of which is arranged at a radially inward or intermediate location.

In particular, the centrifugal pump impeller includes flow ducts, the inlet at the axial side thereof is essentially tangential relative to the outer periphery of the centrifugal pump impeller.

Each nozzle passageway in the star-shaped arrangement is divided vertically by thin partitions, which in adjacent nozzles are so vertically staggered relative to each other (FIG. 6) as to mutually overlap. They are intended to raise the degree of orientation of the short fibers. When a lower viscosity slurry liquid is selected, the nozzle wall can be relatively rough without causing the laminar flow to become turbulent, which would impair the degree of orientation.

A particularly preferable structural embodiment of the present invention is obtained when a centrifugal pump impeller rotating at a somewhat higher speed is arranged within a drum rotating somewhat more slowly about an essentially vertical axis, where a filter is supported on the perforated inner wall of the drum, which is located in the immediate proximity to the radially outer end of the centrifugal pump impeller. The rotating perforated inner wall of the drum acts herein as an inside centrifuge at a high degree of efficiency and compact overall arrangement.

Another arrangement which can advantageously be continuously operated provides in particular that a portion of a roller-conducted, driven perforated endless carrier belt lies opposite to the rotating centrifugal pump impeller along a major portion of its outer circumference, wherein a portion of an endless filter belt is arranged between said carrier belt portion and the oppositely located outer circumference of the centrifugal pump impeller, with this filter belt being driven at the speed of the endless carrier belt, which is lower than the speed of the centrifugal pump impeller (FIGS. 3 and 4).

Suitably, the guide and tension rollers of the endless carrier belt and/or of the filter web are arranged to allow for three-dimensional adjustment.

The filter web leads away from the centrifugal pump impeller in a direction tangential relative to the latter inorder to prevent any premature separation of the fiber mat from the filter.

BRIEF DESCRIPTION OF THE DRAWINGS

Reference may now be had to the following detailed description of the preferred embodiments of the invention, taken in conjunction with the accompanying drawings; in which.

DETAILED DESCRIPTION

Figure 1:
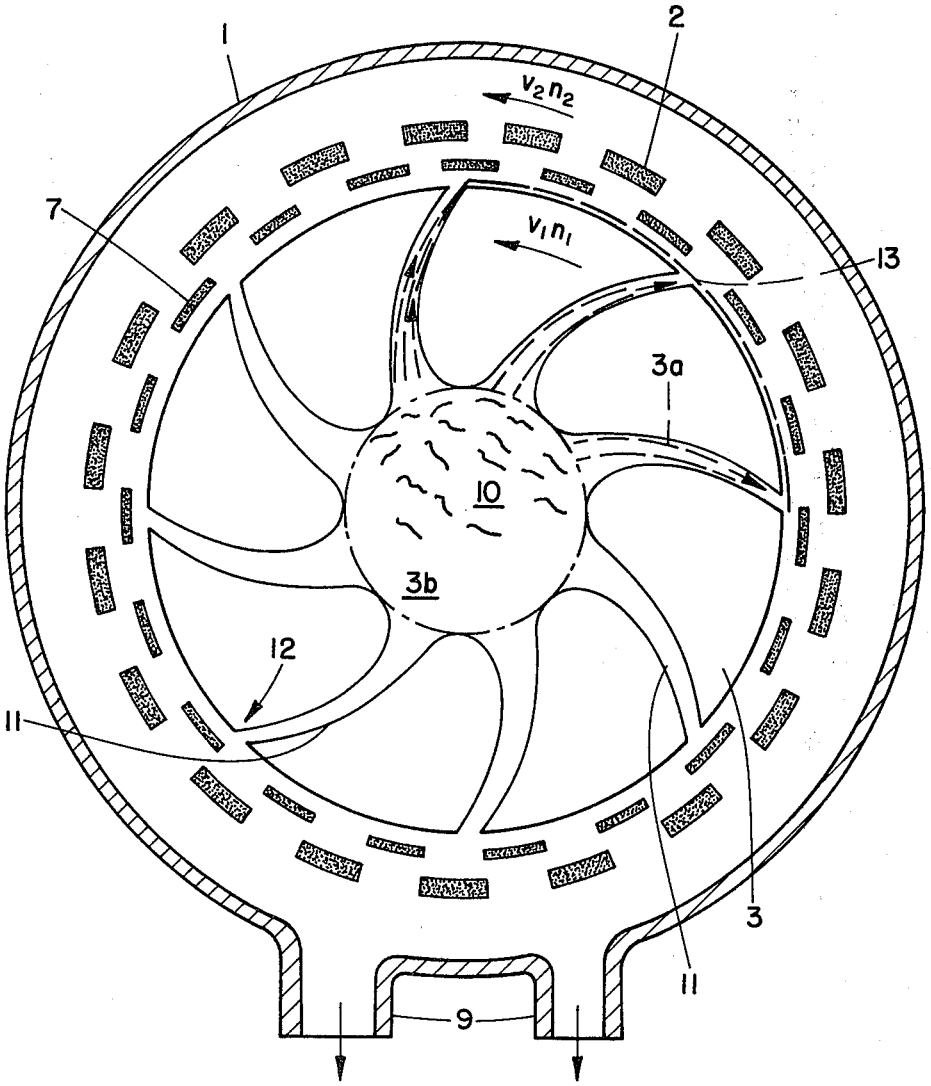
FIG. 1 schematically illustrates a sectional view through an essentially vertically arranged apparatus for discontinuous operation pursuant to the invention.
Figure 2:
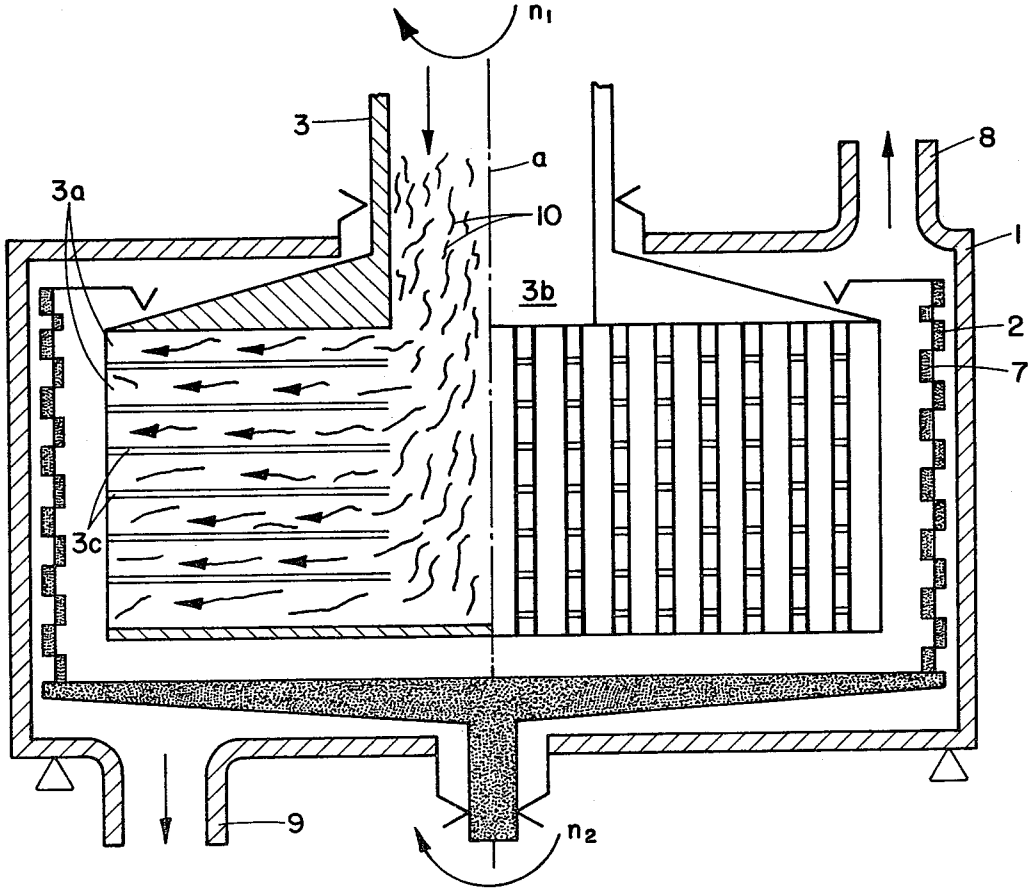
FIG. 2 is a vertical section through the apparatus of FIG. 1 showing the inner centrifugal pump impeller in a partial sectional view.

The discontinuously operated apparatus, schematically shown in FIGS. 1 and 2 of the drawings, for manufacturing planar fiber webs from short, reinforcing fibers oriented in a preferred direction comprises essentially a vertically arranged drum with a stationary drum shroud 1 which is provided at its upper side with a central opening for the inlet of a reinforcing fiber slurry, as well as a vertical outlet 8 for the vacuum connection, and which includes at its bottom side a further eccentrically located, vertical outlet 9 for the filtered out slurry liquid. Additional horizontal outlets 9 for the filtered out slurry liquid are provided along the circumference of the essentially cylindrical shroud.

Arranged within the drum shroud 1 is a perforated inner wall 2 rotating during operation about a vertical axis, with a removable filter cloth 7 and the deposited fiber fleece 13 as shown in the drawing. The arrangement is such that the inner wall serves the function of a conventional, internally supplied centrifugal filter drum.

A centrifugal pump impeller 3 rotates at a speed which differs from and, preferably, is somewhat higher than that of the perforated inner wall 2, and which can also be designated as a pumping wheel or orientation wheel. The axis of rotation a of the centrifugal pump impeller 3 is identical with the axis of rotation of the encompassing centrifugal filter drum.

As can be particularly ascertained from FIG. 1 of the drawings, the centrifugal pump impeller 3 has a plurality of essentially radially extending interior flow passageways 3*a* which are traversed by the laminar flow of the fiber slurry, and the length of their flow forms the orientation section 11. The flow passageways terminate at their radially outer ends in the nozzles 12.

The flow passageways have a hydrodynamic form (sickle shape pursuant to FIG. 1) and are essentially characterized in that the flow inlet is effected approximately radially (radially inwardly), in that the flow outlet from the nozzles 12 is as tangential as possible to the circumference of the centrifugal pump impeller, and the velocity distribution is obtained parabolically due to the laminer flow.

Figure 4:
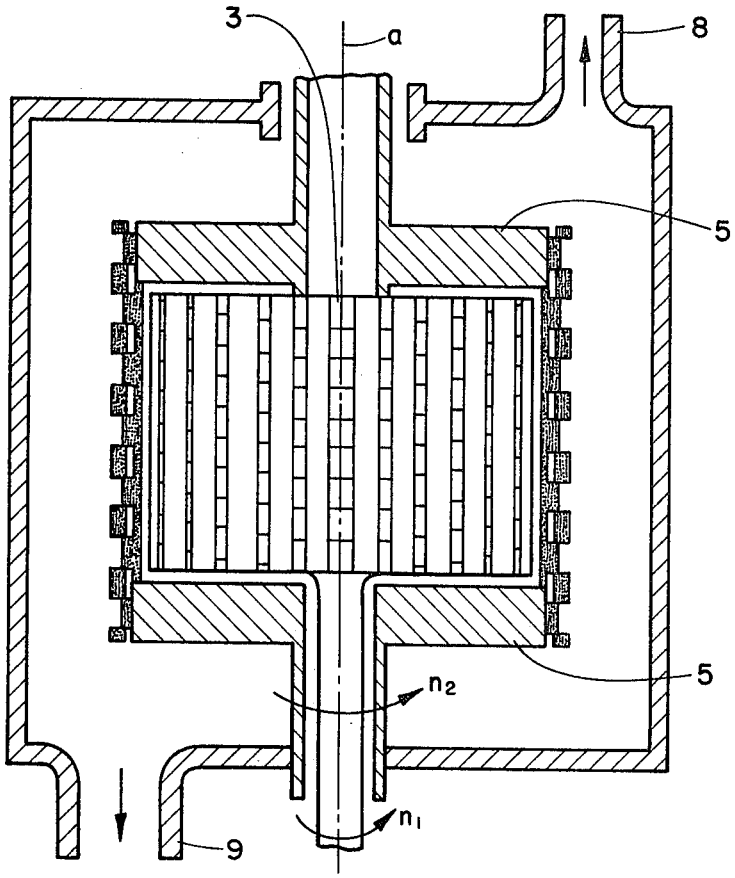
FIG. 4 is a vertical section similar to that of FIG. 2 through the drum of FIG. 3 in the region of the centrifugal pump impeller.

Each flow passageway 3*a* is subdivided into a plurality of orientation sections or nozzles through the use of thin sheet metal partitions 3*c* in planes extending perpendicular to the axis. These nozzles can be disposed vertically and parallel relative to each other, as indicated in FIG. 2, but are preferably mutually disposed vertically offset as shown in FIG. 4. The nozzles can also be disposed in axially parallel arrangement or on a helix generated on the cylindrical surface of the impeller.

A central inlet opening 3*b* for the slurry liquid and the therein distributed non-oriented reinforcing fibers is arranged in the middle of the centrifugal pump impeller 3, at its upper side.

During operation of the arrangement, the inner centrifugal pump impeller 3 is driven by a drive arrangement (not shown) at the speed n1 or v1, and the perforated inner wall 2 of the centrifugal filter drum is driven at the speed n2 or v2, wherein the rotational speed n1 of the centrifugal impeller 3 is preferably slightly higher than the speed n2 of the outer centrifugal filter drum, the perforated inner wall 2 of which rotates about the same axis a as that of the centrifugal pump impeller 3. The filter cloth or fleece which is removably applied on the perforated inner wall 2, which defines the filter surface 7, is positioned intermediate the radially outer outlets of the centrifugal pump impeller 3 and the encompassing perforated inner wall 2, such that the reinforcing fibers 10 in the slurry, which during operation are centrally conveyed into the apparatus, enter the essentially radially extending flow passageways 3*c* of the nozzles 12, are therein oriented along the formed laminer flow, and then accelerated radially outwardly through the nozzles 12 onto the filter surface 7. The filter surface 7 rotates hereby at the speed of the perforated inner wall 2, which is slightly lower than that of the inner centrifugal pump impeller 3, so that during the egress of the essentially oriented fibers from the nozzle, there is encountered a short delay which will still further improve the orientation. The oriented fibers 13 which are stabilized through the socalled "transfer-delay", are deposited on the filter surface 7, which concurrently filters off slurry liquid under the centrifugal force and fixes the filter cake from the oriented deposited fibers 13 on the filter surface. The slurry liquid which is centrifuged out exits from the apparatus through the outlets 9 and can be reused after a filtering out of fiber particles. Due to the high pumping action of the centrifugal pump impeller 3 which acts as an impeller and orientation wheel, the flow passages can be narrowed with a suitable configuration and have relatively rough surfaces, while the viscosity of the slurry liquid is concurrently extensively lowered without causing the laminar parabolic distribution of the flow velocity, which is needed for orientation, to deviate into a turbulent flow. This enables the utilization of solvents as slurry liquids, which can be readily evaporated by subsequent drying, or which can be correlated with the subsequent impregnating process of the impregnating resin, which normally also contains solvents. This resin, which normally also contains solvents. This eliminates the need for repeated, time-consuming washing and rewashing of conventional UD mats. Instead, if needed, a small portion of the resin or resin hardener mixture can be added to the slurry solvent as a temporary binder.

Figure 3:
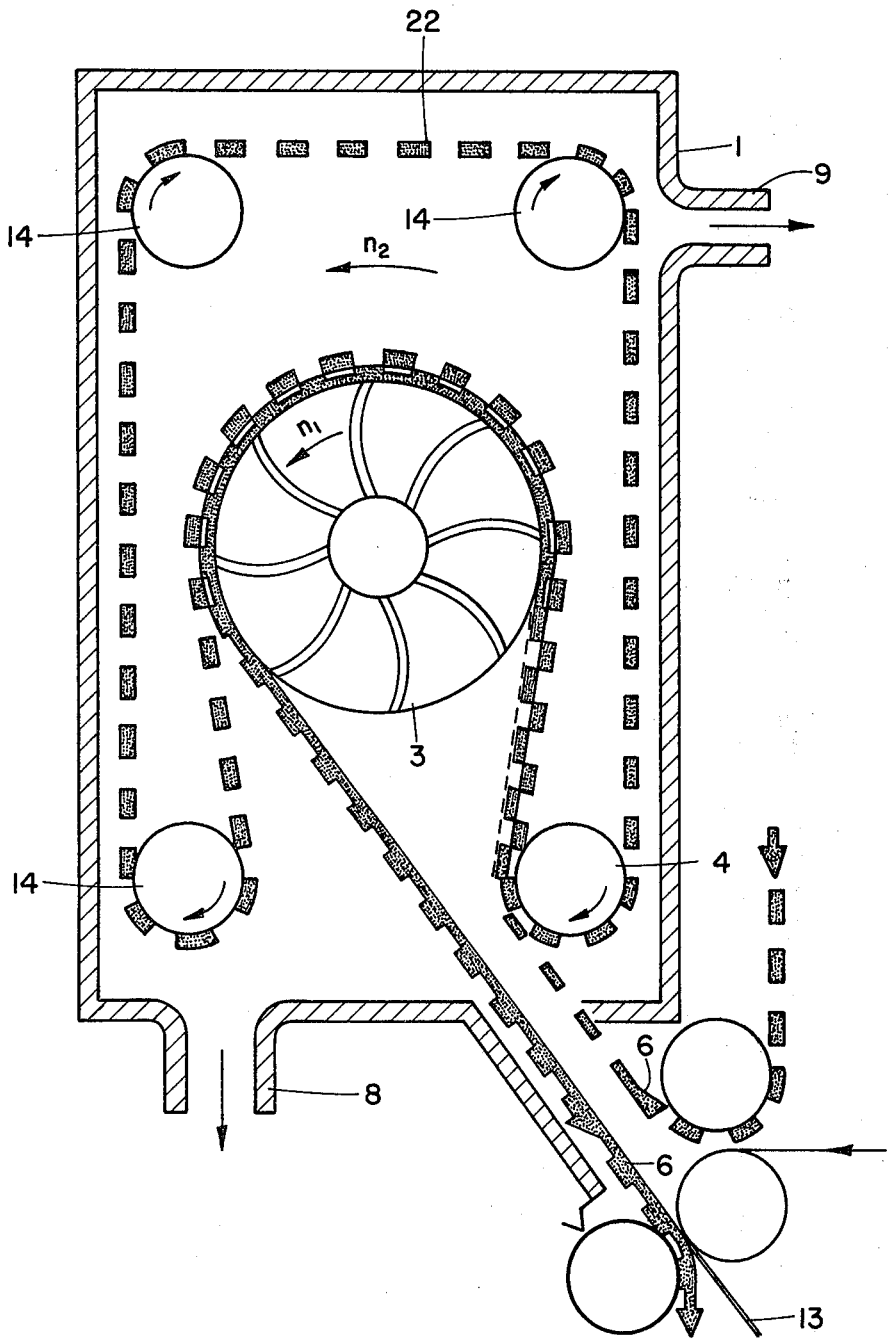
FIG. 3 is a sectional view similar to that of FIG. 1 of a modified apparatus for preferably continuous operation.

The modified embodiment of the apparatus of the present invention as schematically illustrated in FIGS. 3 and 4 allows for continuous operation. A centrifugal pump impeller 3, as previously illustrated in the embodiment of FIGS. 1 and 2, is arranged within an encompassing box-like drum shroud 1, which has vacuum extraction outlets 8 and outlets 9 for the slurry liquid centrifuged off as illustrated in FIGS. 1 and 2.

In lieu of the centrifugal filter drum of the preceding embodiment, a preferably endless fiber belt 6 is conveyed about almost the entire periphery of the centrifugal pump impeller 3 in a manner wherein the belt exits in a direction preferably tangential to the centrifugal pump impeller in order to prevent any premature detaching of the fiber mat from the filter.

The filter belt 6 which defines the filter surface 7, is supported and concurrently transported by means of one or more, likewise perforated, endless support webs or transport belts 22 which are driven by two guide rollers 5 at a speed n2 which slightly differs from the speed n1 of the centrifugal pump impeller 3, wherein the speed of the centrifugal pump impeller 3 is preferably selected so as to be high than the speed of the endless support belt 22.

The endless support belt or belts 2 are suitably guided within the drum shroud 1 over guide rollers 14 and a tension roller 4.

If desired, the circumferential portion of the centrifugal pump impeller 3 which is not encompassed by the filter belt 6 can contain a directly adjoining, vertically extending screen which will prevent fibers egressing in that region from the centrifugal pump impeller 3 from uncontrolledly impinging against the filter belt 6.

As in the first embodiment, also in this instance, the filtration process, besides the centrifugal action, can also be supported by the application of a partial vacuum over a portion of the circumference of the centrifugal pump impeller.

If it is intended to employ the resulting UD short fiber mat itself as a semifinished product, a separating and carrier foil is preferably rolled on subsequent to the impregnating and drying process, while concurrently there is peeled off the filter belt.

A premature detaching of the filter cake (the UD fiber mat) can be prevented through the application of a (partial) vacuum behind the filter belt until the (air-impermeable) separating and carrier foil has been rolled on.

However, for other requirements, at a suitable selection of the filter belt material, this belt material itself can be the carrier and an integral component of the semi-finish UD short fiber mat (for instance, a glass fiber reinforced fleece mat having a poorly soluble binder as a substrate and for increasing the impact strength of the glass fiber-reinforced UD short fiber mat). The finished product will then be a hybrid laminate onto which the separating foil is rolled after impregnating and drying.

The continuous orientation and deposition process can be used at a suitable construction (for example, replacing the filter belt 6 with an externally-cooled steel belt), also in the manufacture of short fiber-reinforced glass, ceramic or metal foils.

What is claimed is:

1. In a method for the manufacture of planar fiber webs of short, oriented reinforcing fibers or fiber blends, including converting the reinforcing fibers or fiber blends into a slurry through the addition of a slurry liquid,; passing the slurry through an orientation section, filtering off the liquid; deposting the fibers in an oriented condition on a filter surface; the improvement comprising conveying the slurry fibers or fiber blends at a central location to the inlets of essentially laminar-flow, hydrodynamic orientation sections arranged in a star-shaped configuration and rotating about a central axis, said orientation sections each comprising a substantially radially oriented inlet and a substantially tangentially oriented outlet, and wherein said filter surface which at least partially encompasses the orientation section rotates concentrically with the orientation section at a slightly different rotational speed.

2. Method as claimed in claim 1, comprising utilizing the slurry liquid, after filtering, for repeated slurry formation.

3. Method as claimed in claim 1, in that the viscosity of the slurry liquid is low.

4. Method as claimed in claim 1, wherein said slurry liquid comprises a solvent correlated with a solvent-bearing impregnating resin employed in an impregnating process subsequent the filtering step.

5. Method as claimed in claim 4, comprising adding a minor portion of resin or resin hardener mixture to the slurry solvent as a temporary binder.

6. Method as claimed in claim 1, comprising enhancing the filtration step through at least a partial vacuum acting on the radially outer region of the filter surface.

7. Method as claimed in claim 1, comprising depositing a separating carrier foil after a fiber impregnating or drying operation, on the oriented, deposited fibers, and lifting off the filter surface.

8. Method as claimed in claim 1, said filter surface forming an integral support for the oriented reinforcement fibers.

9. Method as claimed in claim 1, for use in the manufacture of short fiber-reinforced glass, ceramic or metal foil.

10. Apparatus for the manufacture of planar fiber webs of short, oriented reinforcing fibers or fiber blends, comprising a centrifugal pump impeller rotating about a central axis and having substantially radially extending laminar-flow passageways, a pump inlet of said impeller for receiving a slurry with reinforcing fibers therein being arranged at a radially inward or central location, said centrifugal pump impeller having flow passageways the inlets of which near the axis are substantially radial, and outlet nozzle means directed essentially tangentially relative to the outer displacements zone of the impeller and being arranged in a star-shaped arrangement, said centrifugal pump impeller being concentrically arranged within a drum rotating about essentially a vertical axis at a lower speed than said impeller; and a filter being supported on a perforated inner wall of the drum in immediate proximity to the radially outer end of the centrifugal pump impeller.

11. Apparatus as claimed in claim 1, wherein each of the flow passageways of the star-shaped arrangement is subdivided by thin partitions which are vertically staggered in adjacent nozzles so as to reciprocally overlap.

12. Apparatus as claimed in claim 10, comprising a portion of a driven, roller-guided, perforated endless carrier belt lying contiguous to the rotating centrifugal pump impeller over a major portion of the circumference of the impeller, a portion of an endless filter belt being arranged between said first belt portion and the opposite outer circumference of the centrifugal pump impeller, said filter belt being driven at the speed of the endless substrate belt which is lower than the speed of the centrifugal pump impeller.

13. Apparatus as claimed in claim 12, wherein guide and tension rollers for the endless carrier belt and for the filter belt are arranged to facilitate three-dimensional adjustment of the belt arrangement.

14. Apparatus as claimed in claim 12 or 13, wherein the filter belt raises away from the centrifugal pump impeller in a direction tangential to the impeller.

15. Apparatus as claimed in claim 12, the filter cake is prevented from separating from the filter belt through at least a partial vacuum applied behind the belt until deposition of a separating or carrier foil.

* * * * *